US008322065B2

(12) United States Patent
Faifer

(10) Patent No.: US 8,322,065 B2
(45) Date of Patent: Dec. 4, 2012

(54) MAGAZINE CARRIER

(76) Inventor: Tuvia Faifer, Mishmar Hashiva (IL)

( * ) Notice: Subject to any disclaimer, the term of this patent is extended or adjusted under 35 U.S.C. 154(b) by 85 days.

(21) Appl. No.: 12/942,043

(22) Filed: Nov. 9, 2010

(65) Prior Publication Data

US 2011/0107645 A1 May 12, 2011

Related U.S. Application Data

(60) Provisional application No. 61/260,042, filed on Nov. 11, 2009.

(51) Int. Cl.
*F41C 27/00* (2006.01)
*F42B 39/00* (2006.01)

(52) U.S. Cl. ..... 42/90; 206/3

(58) Field of Classification Search ..... 42/49.01, 42/49.02, 49.1, 90; 206/3, 317
See application file for complete search history.

(56) References Cited

U.S. PATENT DOCUMENTS

| | | | | | |
|---|---|---|---|---|---|
| 1,756,677 | A * | 4/1930 | Cook | 224/245 |
| 3,066,791 | A * | 12/1962 | Bivens | 206/3 |
| 4,447,976 | A * | 5/1984 | Cooper | 42/49.02 |
| 4,467,947 | A * | 8/1984 | Minneman | 224/674 |
| 4,484,403 | A * | 11/1984 | Schwaller | 42/50 |
| 5,152,442 | A * | 10/1992 | Gallagher | 224/245 |
| 6,698,129 | B1 * | 3/2004 | Hanks | 42/90 |
| 2007/0278269 | A1 * | 12/2007 | Rogers et al. | 224/239 |

* cited by examiner

*Primary Examiner* — Bret Hayes
(74) *Attorney, Agent, or Firm* — Deborah Gador

(57) ABSTRACT

A magazine carrier for a firearm, the magazine carrier including a frame having walls to releasably hold an ammunition magazine, and an external track element defined on the frame for engaging a complementary engagement element. The complementary track element can be on a clip, on an adapter or on another similar frame.

12 Claims, 5 Drawing Sheets

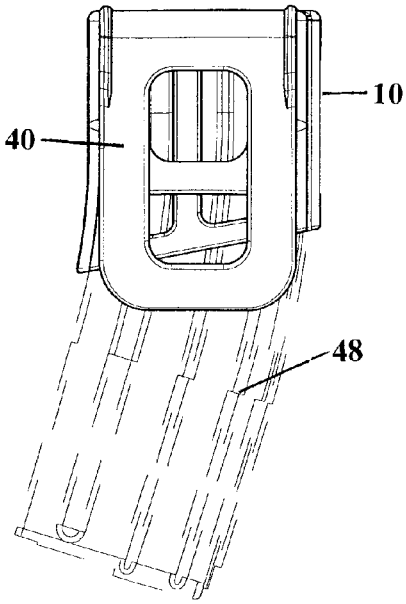
Fig.9(left side)
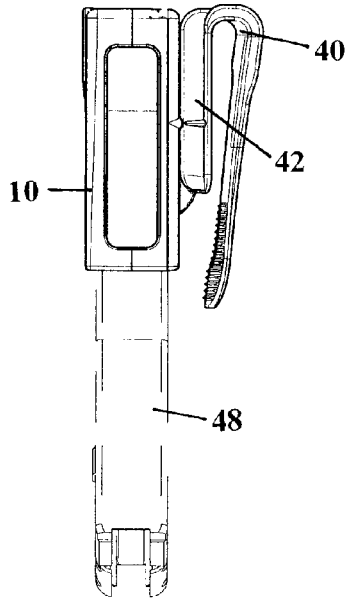
Fig.10
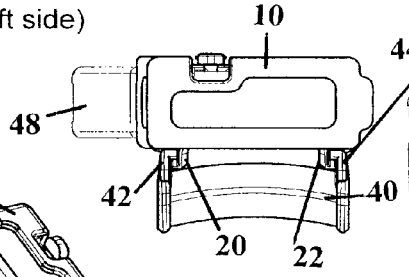
Fig.11
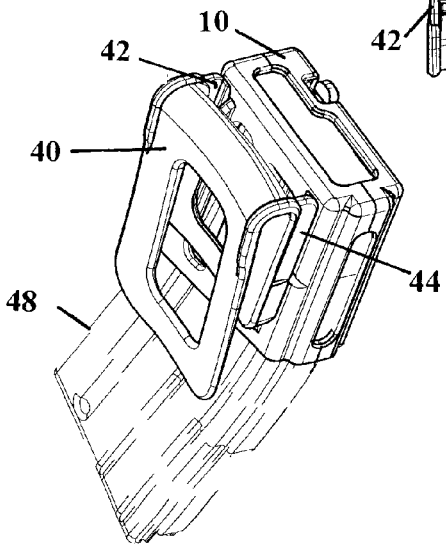
Fig.12
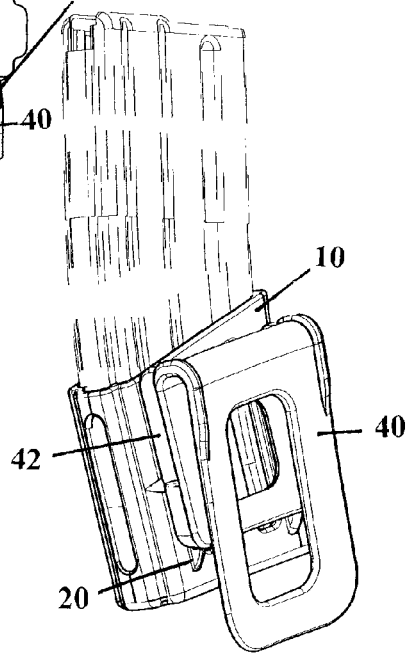
Fig.13

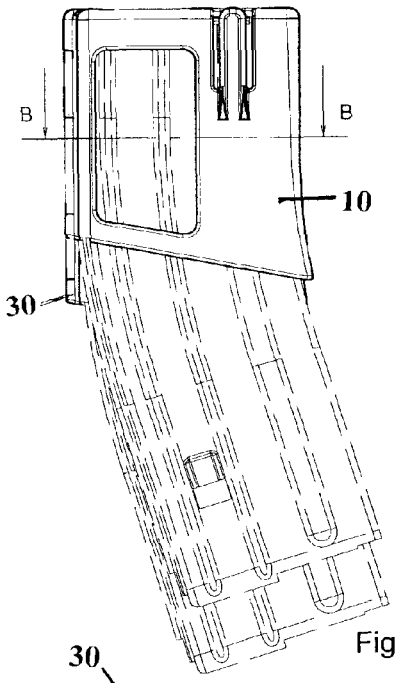
Fig.20
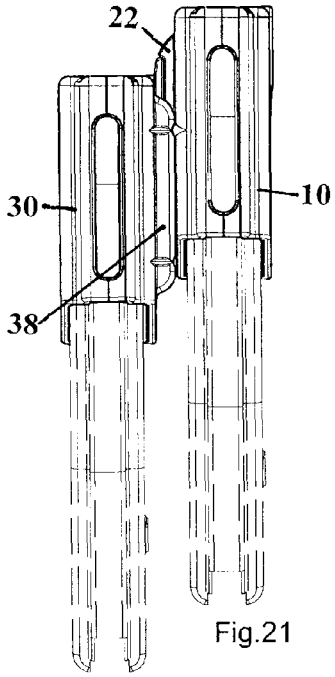
Fig.21
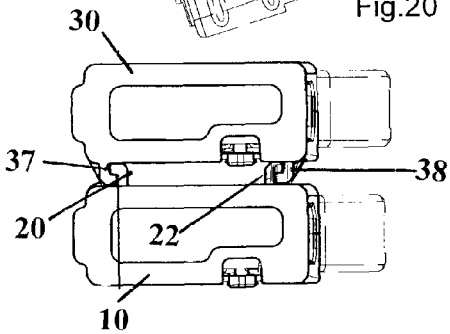
Fig.22
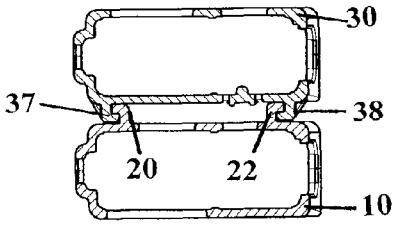
Fig.23(Section B-B)
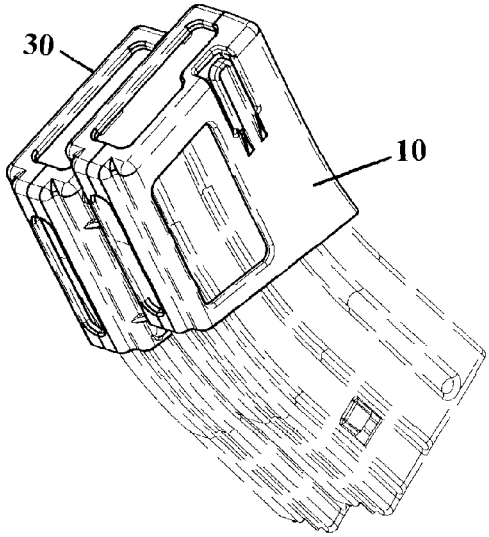
Fig.24

MAGAZINE CARRIER

FIELD OF THE INVENTION

The present invention relates to magazine carriers, in general and, in particular, to magazine carriers for firearms, such as M-16 rifles, submachine guns, handguns, and the like.

BACKGROUND OF THE INVENTION

It is often desired to carry one or two spare ammunition magazines for a firearm. In order to carry the magazine outside of the rifle, it must be carried on the person, as in a belt or other holder. When it is time to replace the magazine, the old magazine must be removed and a new magazine retrieved from its storage location, generally on an ammunition belt, before it can be inserted in place.

There are known multi-magazine holders, such as that shown in U.S. Pat. No. 5,253,442, and devices for coupling two magazines to one another to enable a soldier to carry more ammunition in a readily available location on the firearm when a single magazine is not sufficient. These devices do not solve the problem of traveling with a magazine in a secure but available position.

U.S. Pat. No. 5,636,465 describes a protective carrier for holding a loaded spare magazine in a position of readiness for immediate insertion into operative engagement with a firearm. A latch mechanism in the carrier simultaneously releases the spent magazine, permitting an empty magazine and a loaded spare magazine to be released together. This carrier does not solve the problem of traveling with a magazine in a secure but available position. In addition, the location of the protective carrier makes it difficult to reach various parts of the rifle on which it is mounted.

Accordingly, there is a long felt need for a carrier for a spare magazine which is flexible for mounting on a belt or pocket, and it would be very desirable to have such a magazine carrier which can be coupled to another similar carrier.

SUMMARY OF THE INVENTION

There is provided according to the present invention a magazine carrier for a firearm, the magazine carrier including a frame having walls for receiving and releasably holding an ammunition magazine, the frame defining an external track element for releasably engaging a complementary engagement element.

According to one embodiment of the invention, the magazine carrier further includes a clip member, the clip member having a complementary engagement element for engagement by the track element on the frame, so as to mount the magazine carrier on a belt, a pouch or in a pocket.

According to another embodiment of the present invention, the magazine carrier further includes a second frame having walls for receiving and releasably holding an ammunition magazine, the second frame having a complementary engagement element, preferably a complementary track element, for engagement by the track element on the first frame, permitting carrying of two magazines together.

According to a preferred embodiment, the magazine carrier frame further defines a releasable locking element for releasably engaging a magazine.

There is also provided a method for forming a magazine carrier for a firearm, the method including forming a frame having walls for releasably holding an ammunition magazine, and forming an external track element on the frame for releasably engaging a complementary engagement element on a clip member, an adapter, or to another similar carrier.

BRIEF DESCRIPTION OF THE DRAWINGS

The present invention will be further understood and appreciated from the following detailed description taken in conjunction with the drawings in which:

FIG. 9 is a plan view illustration of the magazine carrier of FIG. 1 with a clip member, holding an ammunition magazine;

FIG. 10 is an end view of the magazine carrier of FIG. 9;

FIG. 11 is a bottom view of the magazine carrier of FIG. 9;

FIG. 12 is a side perspective view of the magazine carrier of FIG. 9;

FIG. 13 is a plan view illustration of the magazine carrier of FIG. 1 with a clip member mounted in an alternative orientation, holding an ammunition magazine;

FIG. 20 is a plan view illustration of the magazine carrier of FIG. 1 coupled to the magazine carrier of FIG. 5, each holding an ammunition magazine;

FIG. 21 is an end view of the magazine carriers of FIG. 20;

FIG. 22 is a bottom view of the magazine carriers of FIG. 20;

FIG. 23 is a sectional view of the magazine carriers of FIG. 20 taken along line B-B; and FIG. 24 is a side perspective view of the magazine carriers of FIG. 20.

DETAILED DESCRIPTION OF THE INVENTION

The present invention relates to a magazine carrier which is adapted for mounting on a belt, pouch, vest, and so on, and is designed to hold one or two magazines. This is accomplished, according to the present invention, by providing a carrier for the magazine of a firearm including a frame having walls for releasably holding an ammunition magazine, and an external track element formed on the frame for releasably engaging a complementary engagement element. The complementary engagement element can be any element permitting releasable coupling to the track element on the holder, for example, a complementary track, loops, one or more catches or hooks, etc. The engagement element can be of the same length as the track element or a different length.

Figure 1:
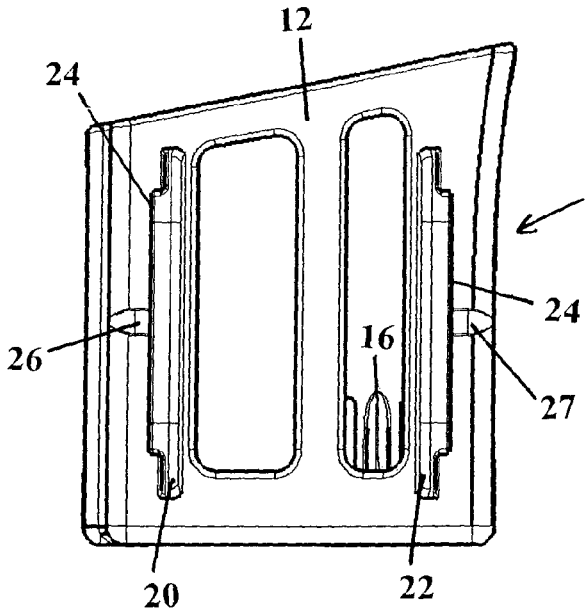
FIG. 1 is a plan view illustration of a magazine carrier constructed and operative in accordance with one embodiment of the present invention.
Figure 2:
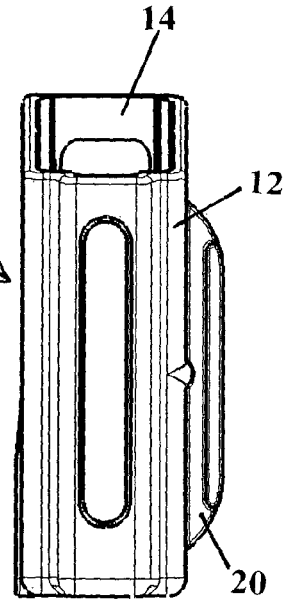
FIG. 2 is an end view of the magazine carrier of FIG. 1.
Figure 3:
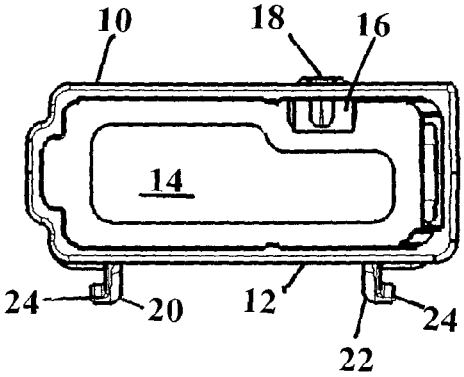
FIG. 3 is a top view of the magazine carrier of FIG. 1.
Figure 4:
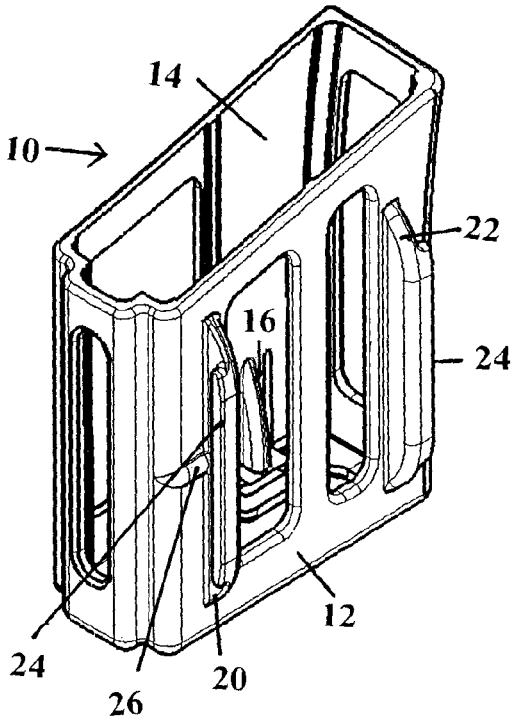
FIG. 4 is a side perspective view of the magazine carrier of FIG. 1.

Referring now to FIG. 1, there is shown a plan view illustration of a magazine carrier 10 constructed and operative in accordance with one embodiment of the present invention. FIGS. 2, 3 and 4 are end, top and side perspective views, respectively, of the magazine carrier of FIG. 1. Magazine carrier 10 includes a substantially hollow frame 12 formed of four walls, defining an internal recess 14 shaped to hold the lower end of an ammunition magazine. Magazine carrier 10 is shaped to hold a conventional removable magazine, and has a releasable locking mechanism 16 for locking the magazine in place. In the illustrated embodiment, releasable mechanism 16 includes a flexible tab 18 to retain the magazine inside the magazine carrier 10 and to release it when tab 18 is pressed. The particular locking mechanism may depend on the particular ammunition magazine with which the carrier is to be used, and may be substantially identical to that in the original magazine holder of the firearm.

It is a particular feature of the invention that magazine carrier 10 further includes a pair of track elements 20, 22 on one external side face of the frame 12. Track elements 20, 22 are designed to releasably engage one or more complementary engagement elements on another object, such as a clip member, an adapter, a second complementary magazine carrier, etc. As can best be seen in FIG. 3, the track elements in this embodiment define outward facing flanges 24.

Preferably, stop members, here shown as raised ribs 26, 27, are provided on frame 12 for engaging complementary stop elements on the other object.

Figure 5:
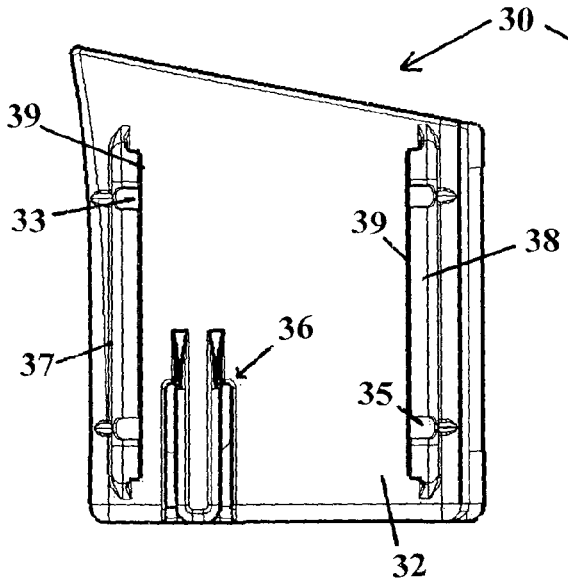
FIG. 5 is a plan view illustration of a magazine carrier constructed and operative in accordance with another embodiment of the present invention.
Figure 6:
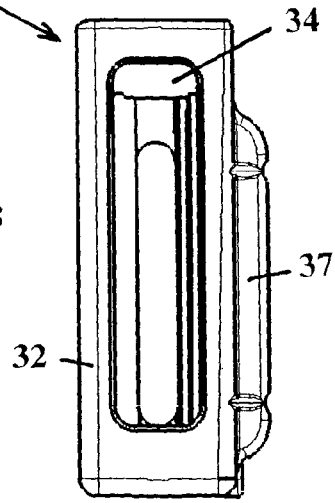
FIG. 6 is an end view of the magazine carrier of FIG. 5.
Figure 7:
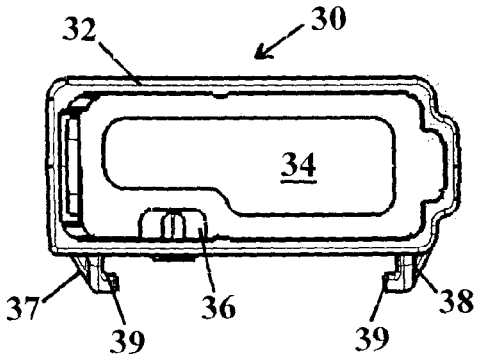
FIG. 7 is a top view of the magazine carrier of FIG. 5.
Figure 8:
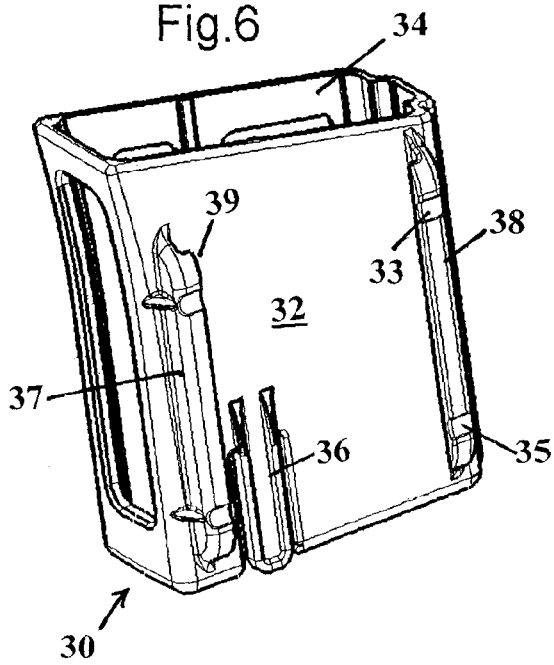
FIG. 8 is a side perspective view of the magazine carrier of FIG. 5.
Figure 14A:
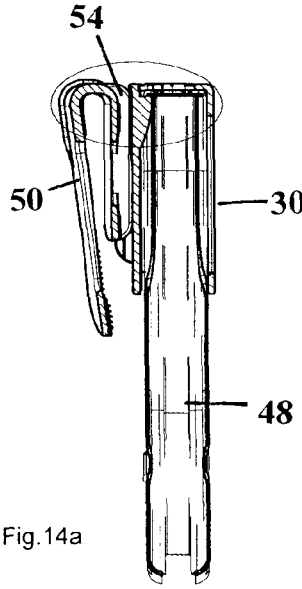
FIG. 14*a* is a sectional view of the magazine carrier of FIG. 15 taken through line A-A.

Referring now to FIG. 5, there is shown a plan view illustration of a magazine carrier 30 constructed and operative in accordance with another embodiment of the present invention. FIGS. 6, 7 and 8 are end, top and side perspective views, respectively, of the magazine carrier of FIG. 5.

Magazine carrier 30 includes a substantially hollow frame 32 formed of walls defining an internal recess 34 shaped to hold the lower end of an ammunition magazine. Magazine carrier 30 is shaped to hold a conventional removable magazine and has a releasable locking mechanism 36 for locking the magazine in place. Magazine carrier 30 further includes a pair of track elements 37, 38 on one external side face of the frame 32. Track elements 37, 38 are designed to releasably engage one or more complementary engagement elements on another object, such as a clip member, an adapter, a second complementary magazine carrier, etc. As can best be seen in FIG. 7, the track elements 37, 38 in this embodiment define inwardly facing flanges 39.

Preferably, stop elements, here shown as grooves 33, 35, are provided on frame 32 for engaging complementary stop members on the other object. It will be appreciated that, in the illustrated embodiment, two sets of stop elements are provided to permit releasable locking in either of two different locations.

A side view illustration of the magazine carrier 10 of FIG. 1 in use is illustrated in FIG. 9. FIGS. 10, 11 and 12 are end, bottom and side perspective views, respectively, of the magazine carrier of FIG. 9. Magazine carrier 10 is illustrated here engaging a clip member 40 and holding a magazine 48. Clip member 40 is generally U-shaped and includes, on one outside surface, a pair of complementary track elements 42, 44 defining inwardly facing flanges for engagement by the track elements 20, 22 on magazine carrier 10, so as to mount the magazine carrier on a belt, on or in a pocket, or the like.

According to a preferred embodiment, the track elements are symmetrical longitudinally, so that they can be engaged in either direction (from either end of the element). For example, it can be seen that the clip member in FIG. 9 is mounted in an orientation such that the magazine hangs downwardly from the carrier. Alternatively, as shown in FIG. 13, the clip member can be mounted in an alternative orientation, from the opposite direction relative to the carrier, so that the magazine points upwardly from the carrier. In each of these orientations, a different stop element on the carrier or clip can be utilized for releasably locking the clip relative to the carrier.

Figure 15:
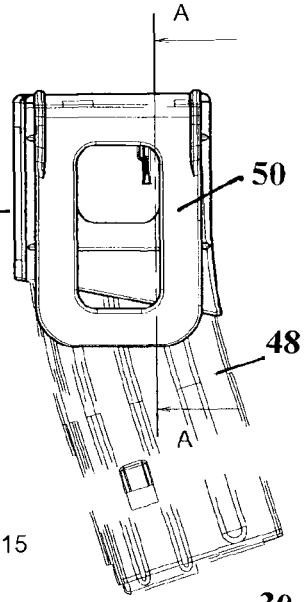
FIG. 15 is a plan view illustration of the magazine carrier of FIG. 5 with a clip member, holding an ammunition magazine.
Figure 16:
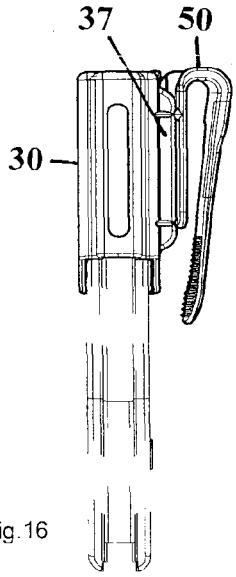
FIG. 16 is an end view of the magazine carrier of FIG. 15.
Figure 14B:
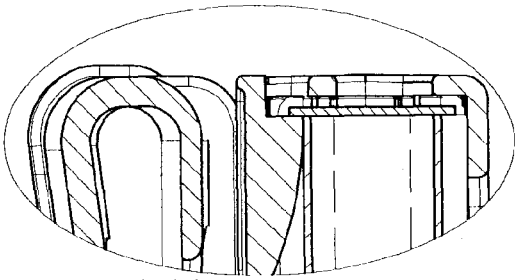
FIG. 14*b* is a detail view of the encircled portion of the magazine carrier of FIG. 14*a;*
Figure 17:
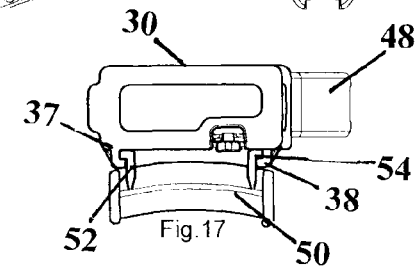
FIG. 17 is a bottom view of the magazine carrier of FIG. 15.
Figure 18:
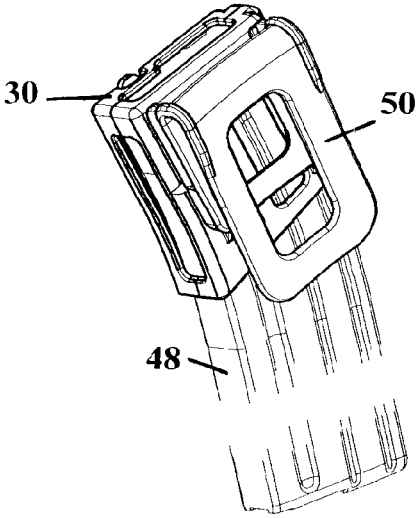
FIG. 18 is a side perspective view of the magazine carrier of FIG. 15.

It will further be appreciated that a clip member 50 can also be mounted on magazine carrier 30 of FIG. 5. This option is illustrated in plan view in FIG. 15, showing magazine carrier 30 holding a magazine 48. FIGS. 14, 16, 17 and 18 are sectional end, bottom and side perspective views of the magazine carrier of FIG. 15. In the illustrated embodiment, clip member 50 has complementary track members 52, 54 (defining outwardly facing flanges) for engaging track elements 37, 38, although any other complementary engagement element or elements can alternatively be utilized.

Figure 19:
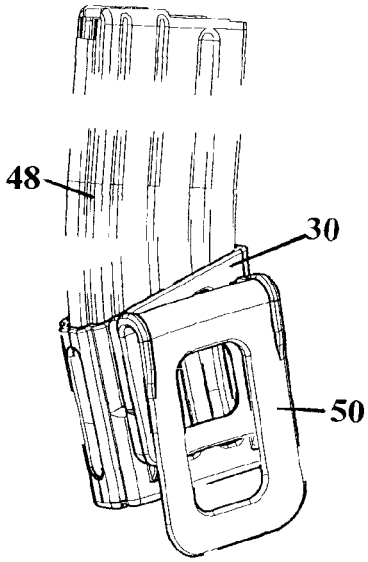
FIG. 19 is a plan view illustration of the magazine carrier of FIG. 5 with a clip member mounted in an alternative orientation, holding an ammunition magazine.

As in the case of FIG. 9, clip member 50 in FIG. 15 is mounted in an orientation such that the magazine hangs downwardly from the carrier. Alternatively, as shown in FIG. 19, the clip member can engage the magazine carrier from the other direction (upside down), such that the magazine points upwardly from the carrier.

According to another embodiment of the present invention, the magazine carrier further includes a second frame having walls for receiving and releasably holding an ammunition magazine, the second frame having a complementary track for engagement by the track on the first frame, permitting carrying of two magazines together.

By way of example, FIG. 20 is a plan view illustration of the magazine carrier 10 of FIG. 1 coupled to the magazine carrier 30 of FIG. 5, each holding an ammunition magazine. FIGS. 21, 22, 23 and 24 are end, bottom, sectional and side perspective views of the magazine carriers of FIG. 20. As can be seen, track elements 20, 22 (having outwardly facing flanges) are complementary to track elements 34, 36 (having inwardly facing flanges) and permit releasable engagement for coupling two magazine carriers.

The magazine carrier of the present invention may be formed of plastic, metal, or any other suitable material.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A magazine carrier for use with an ammunition magazine having a locking element, the magazine carrier comprising:

a frame having walls shaped to releasably hold an ammunition magazine;

said frame including a releasable magazine locking mechanism for releasably engaging a locking element on a magazine in the magazine carrier;

an external track element defined on said frame; and an object, having a complementary track element, releasably engaging said external track element.

2. The magazine carrier according to claim 1, wherein said object is a clip member, said clip member having said complementary track element for engagement by said external track element on said frame.

3. The magazine carrier according to claim 2, wherein each of said first and second frames further defines a stop element for releasable locking of the frames to one another.

4. The magazine carrier according to claim 1, wherein said object is a second frame having walls for releasably holding an ammunition magazine, said second frame having said complementary track element for engagement by said external track element on said frame.

5. The magazine carrier according to claim 4, wherein said second frame includes a releasable magazine locking mechanism for releasably engaging a magazine in the magazine carrier.

6. The magazine carrier according to claim 1, wherein said frame further defines a stop member engaging complementary stop elements on said object for releasable locking of the frame to said object.

7. The magazine carrier according to claim 1, wherein said external track elements and said complementary track elements are inwardly and outwardly facing flanges or vice versa.

8. A method for forming a magazine carrier for a firearm having a magazine holder, the method comprising:

forming a substantially hollow frame having walls to receive and hold an ammunition magazine;

providing a releasable magazine locking mechanism in said frame for releasably engaging a magazine in the magazine carrier;

forming an external track element on said frame; and forming a complementary track element on an object, said complementary track element releasably engaging said external track element.

9. The method according to claim 8, wherein said step of forming a complementary track element includes: forming a clip member, and forming said complementary track element for engagement by said external track element on said clip member.

10. The method according to claim 9, further comprising forming a releasable magazine locking mechanism on said second frame for releasably engaging a magazine in the magazine carrier.

11. The method according to claim 8, wherein said step of forming a complementary track element includes: forming a second frame having walls for releasably holding an ammunition magazine, and forming on said second frame said complementary track element for engagement by the external track element on the first frame.

12. The method according to claim 8, wherein said step of forming a frame includes forming a stop element on said frame;

further comprising forming a complementary stop member on said object; and engaging said stop element on said frame with said complementary stop members on said object.

* * * * *